US012520950B2

(12) United States Patent
Duggan

(10) Patent No.: US 12,520,950 B2
(45) Date of Patent: Jan. 13, 2026

(54) BLANKET TUNNEL ASSEMBLY

(71) Applicant: James Duggan, Woodland Hills, CA (US)

(72) Inventor: James Duggan, Woodland Hills, CA (US)

( * ) Notice: Subject to any disclaimer, the term of this patent is extended or adjusted under 35 U.S.C. 154(b) by 255 days.

(21) Appl. No.: 18/214,225

(22) Filed: Jun. 26, 2023

(65) Prior Publication Data

US 2024/0423378 A1 Dec. 26, 2024

(51) Int. Cl.
*A47C 21/02* (2006.01)

(52) U.S. Cl.
CPC ..... *A47C 21/024* (2013.01)

(58) Field of Classification Search
CPC ..... A47C 21/00; A47C 21/02; A47C 21/022; A47C 21/024; A47C 21/04; A47C 21/042; A47C 21/044; A47C 21/046
See application file for complete search history.

(56) References Cited

U.S. PATENT DOCUMENTS 307,024 A * 10/1884 Drake ..... A47C 21/024 192/76
985,477 A * 2/1911 Tuttle ..... A47C 21/024 5/505.1
1,072,490 A * 9/1913 Oilar ..... A47C 21/024 5/505.1
1,351,557 A * 8/1920 Dobbins ..... A47C 21/024 5/507.1
1,732,716 A * 10/1929 Ealy ..... A47C 21/024 5/505.1
1,782,276 A 11/1930 Seifarth
2,398,731 A * 4/1946 Voss ..... A47C 21/024 5/505.1
2,598,295 A * 5/1952 Pelton ..... A47C 21/024 5/505.1
2,695,413 A * 11/1954 Ter Maat ..... A47C 21/024 219/217
2,960,151 A 11/1960 Fairgrieve
4,287,622 A * 9/1981 Lane ..... A47C 21/024 5/505.1
4,841,589 A * 6/1989 Moore ..... A47C 21/024 5/505.1
5,978,991 A * 11/1999 Miles ..... A61G 7/0755 5/651
8,001,632 B2 8/2011 Sanders
D690,541 S 10/2013 Rogers
11,103,080 B2 8/2021 Reale
(Continued)

FOREIGN PATENT DOCUMENTS

GB 2177910 2/1987

*Primary Examiner* — George Sun

(57) ABSTRACT

A blanket tunnel assembly includes a frame that has a plurality of arched members strategically arranged such that the frame defines a tunnel. The frame can be positioned on a support surface having the frame extending over a user's legs when the user is either lying on the support surface or sitting on the support surface. The frame is elongated to extend over a full length of the user's legs when the frame is positioned over the user's legs. A blanket is positionable over the frame to cover the user's legs. The blanket is supported by the frame to inhibit the user from feeling the weight of the blanket while still facilitating the user to be warmed by the blanket.

3 Claims, 5 Drawing Sheets

(56) References Cited

U.S. PATENT DOCUMENTS

| | | | | |
|---|---|---|---|---|
| 2005/0273931 | A1* | 12/2005 | Edwards | A47C 21/022 5/505.1 |
| 2008/0295247 | A1* | 12/2008 | Rogers | A47C 21/024 5/505.1 |
| 2010/0319127 | A1* | 12/2010 | Sanders | A61G 7/0501 5/505.1 |
| 2013/0192001 | A1* | 8/2013 | Rensink | A47C 31/00 5/691 |
| 2017/0086596 | A1* | 3/2017 | Kim | A61G 7/0501 |
| 2019/0231080 | A1* | 8/2019 | Reale | A61G 7/0501 |
| 2023/0380599 | A1* | 11/2023 | Miller | A47C 20/021 |

* cited by examiner

BLANKET TUNNEL ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to tunnel devices and more particularly pertains to a new tunnel device for supporting a blanket above a user's legs. The device includes a frame that is structured to define a tunnel to facilitate the frame to be positioned over the user's legs when the user is seated or lying down. The device includes a blanket that is positionable over the frame to keep the user warm while the frame supports the blanket over the user's legs to protect the user's legs from the weight of the blanket.

(2) Description of Related Art Including Information Disclosed Under 37 CFR 1.97 and 1.98

The prior art relates to tunnel devices including a variety of frame devices which generally includes a pair of legs and a central portion supported above a support surface by the pair of legs and a blanket support frame that has a plurality of curved members arcing over a base for supporting a blanket over a user and collapsible blanket support frame that includes a pair of legs pivotally attached to a grate for supporting a blanket over a user's feet. In no instance does the prior art disclose a frame that is structured to define a tunnel which has a length sufficient cover the full length of a user's legs and a blanket that can be positioned over the frame.

BRIEF SUMMARY OF THE INVENTION

An embodiment of the disclosure meets the needs presented above by generally comprising a frame that has a plurality of arched members strategically arranged such that the frame defines a tunnel. The frame can be positioned on a support surface having the frame extending over a user's legs when the user is either lying on the support surface or sitting on the support surface. The frame is elongated to extend over a full length of the user's legs when the frame is positioned over the user's legs. A blanket is positionable over the frame to cover the user's legs. The blanket is supported by the frame to inhibit the user from feeling the weight of the blanket while still facilitating the user to be warmed by the blanket.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
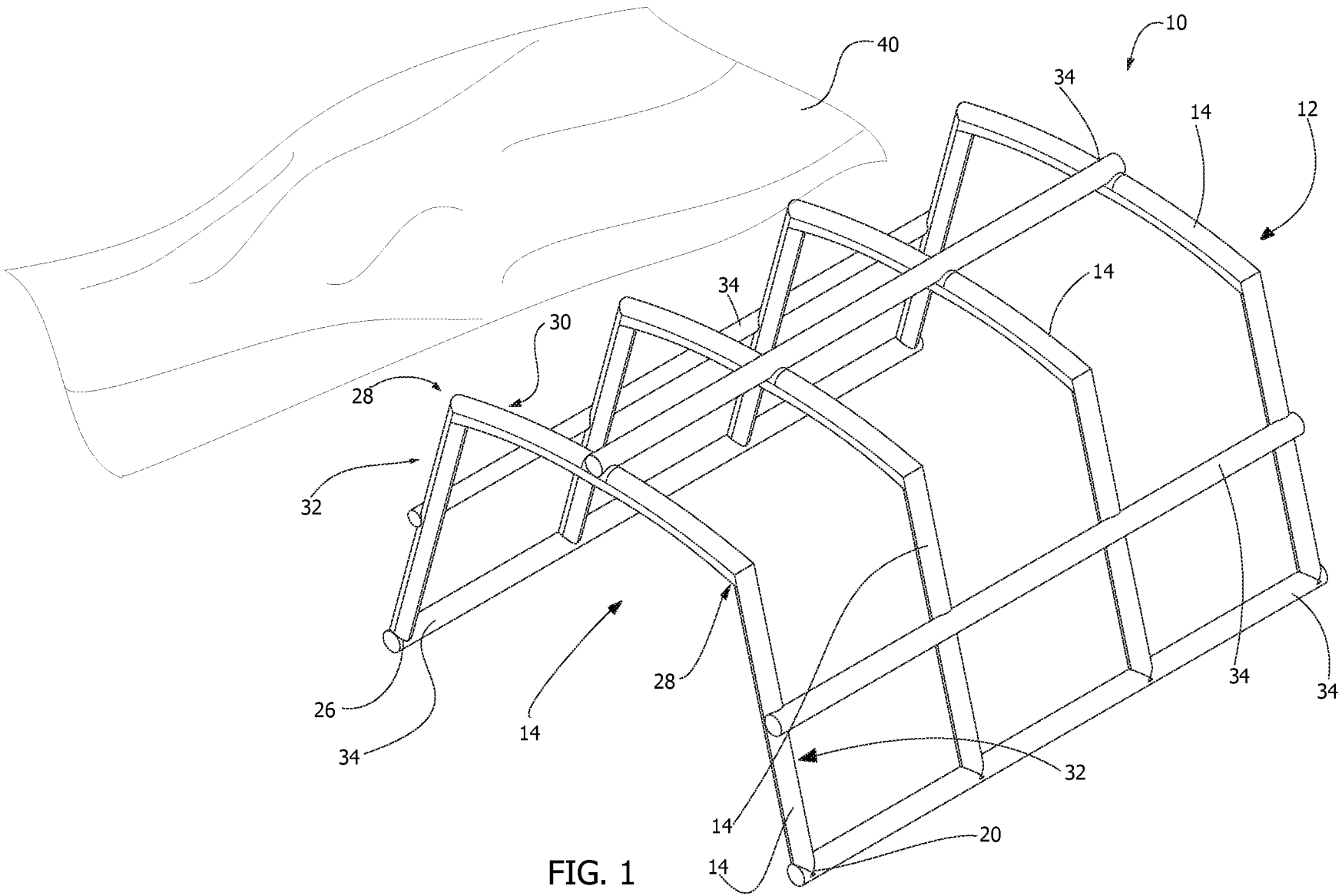
FIG. 1 is a perspective view of a blanket tunnel assembly according to an embodiment of the disclosure.
Figure 3:
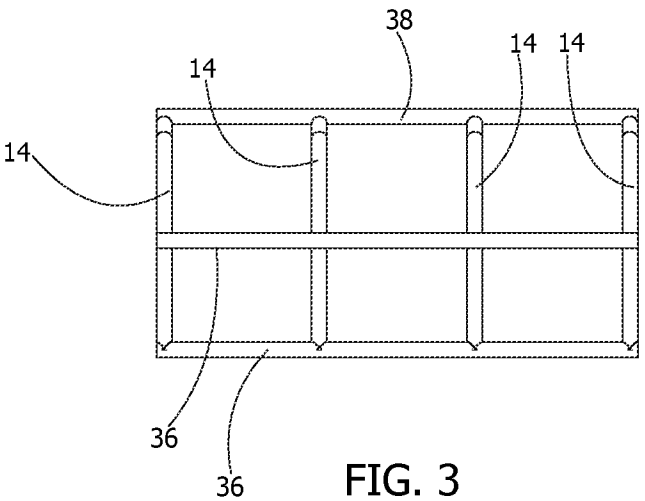
FIG. 3 is a right side view of an embodiment of the disclosure.
Figure 2:
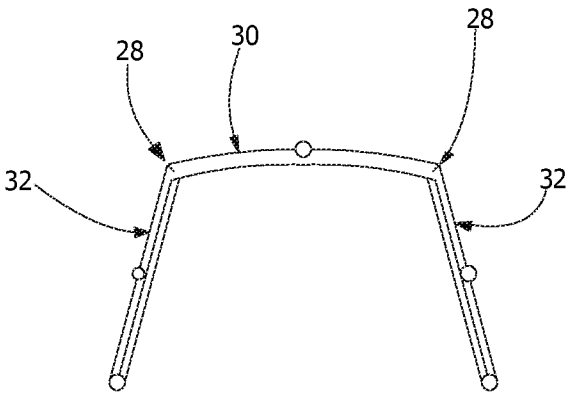
FIG. 2 is a front view of a frame of an embodiment of the disclosure.
Figure 4:
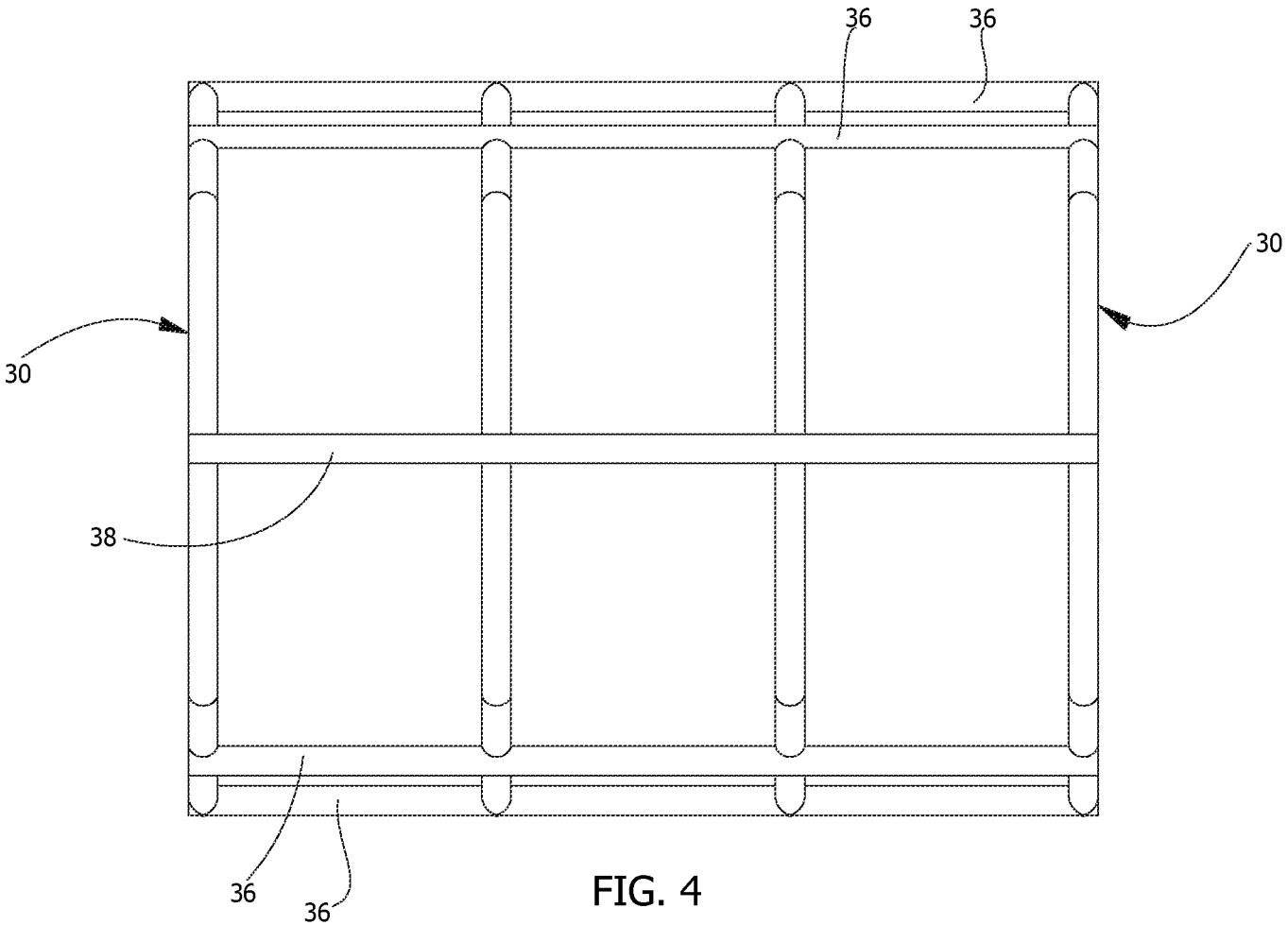
FIG. 4 is a top view of an embodiment of the disclosure.
Figure 5:
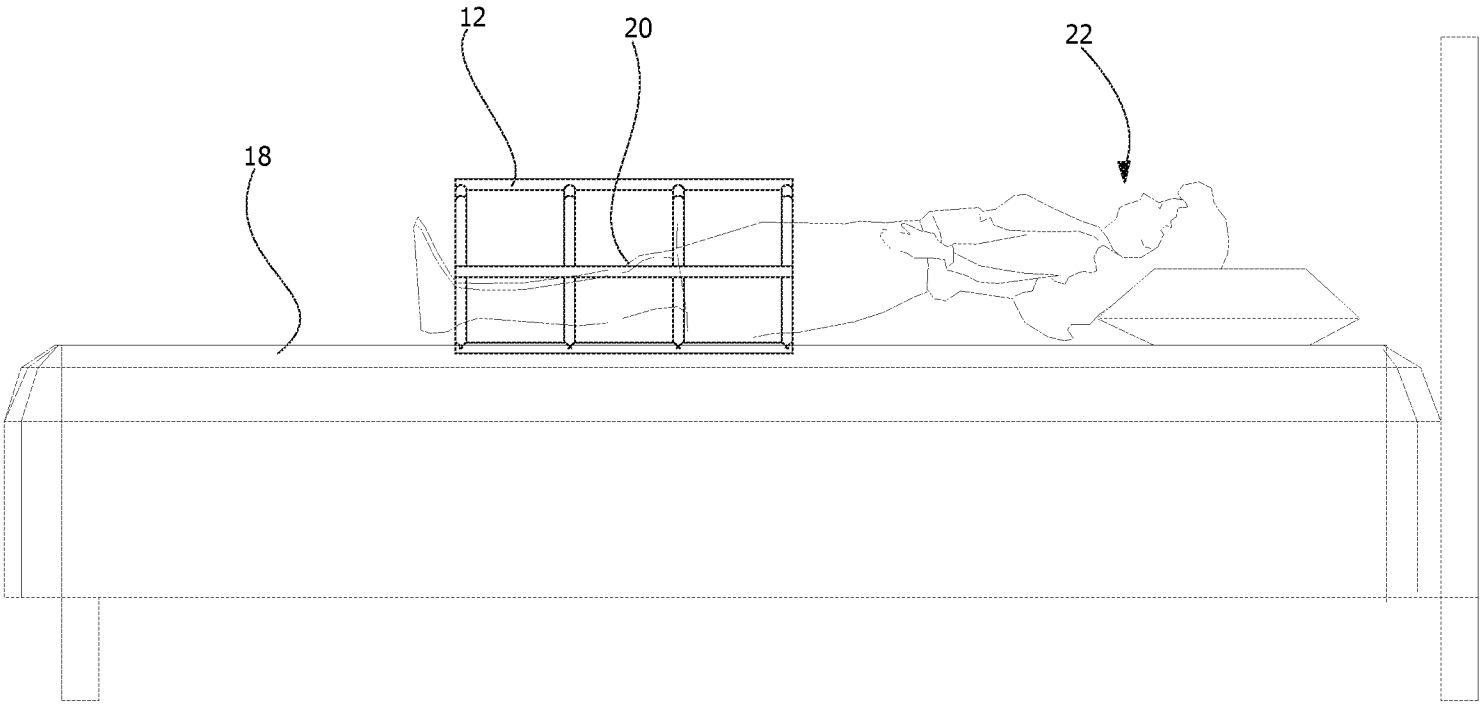
FIG. 5 is a side perspective in-use view of an embodiment of the disclosure.
Figure 6:
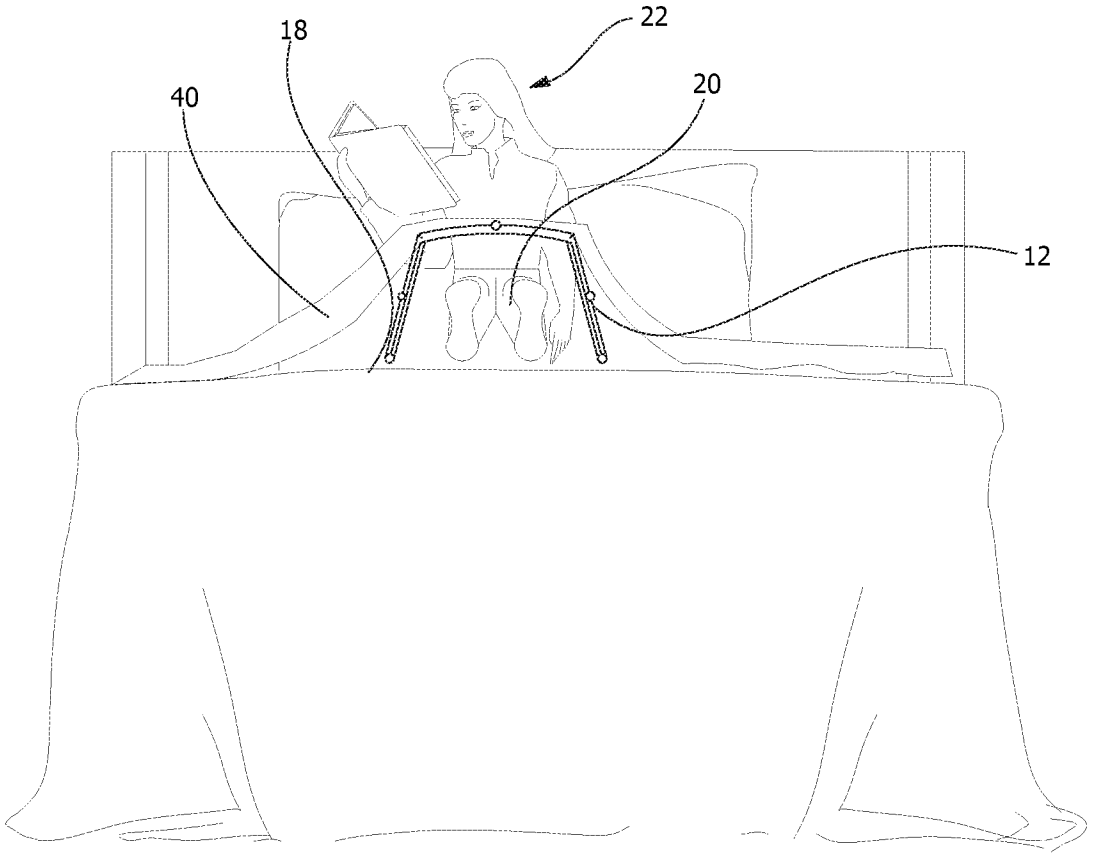
FIG. 6 is a front perspective in-use view of an embodiment of the disclosure.

With reference now to the drawings, and in particular to FIGS. 1 through 6 thereof, a new tunnel device embodying the principles and concepts of an embodiment of the disclosure and generally designated by the reference numeral 10 will be described.

As best illustrated in FIGS. 1 through 6, the blanket tunnel assembly 10 generally comprises a frame 12 that has a plurality of arched members 14 which are strategically arranged such that the frame 12 defines a tunnel 16. In this way the frame 12 can be positioned on a support surface 18 having the frame 12 extending over a user's legs 20 when the user 22 is either lying on the support surface 18 or sitting on the support surface 18. The support surface 18 may be a bed, a floor, an article of furniture or any other horizontal support surface 18 upon which the user 22 could either sit or sleep. Furthermore, the frame 12 is elongated to a sufficient length to extend over a full length of the user's legs 20 when the frame 12 is positioned over the user's legs 20.

Each of the arched members 14 has a first end 24 and a second end 26 and each of the arched members 14 has a pair of bends 28 that are equally spaced from a respective one of the first end 24 and the second end 26 to define a central portion 30 extending between a pair of outward portions 32 of the arched members 14. Each of the outward portions 32 of a respective arched member 14 angles away from each other and the central portion 30 of the respective arched member 14 curves upwardly between the pair of outward portions 32 of the respective arched member 14.

The frame 12 includes a plurality of horizontal members 34 and each of the horizontal members 34 is attached between the plurality of arched members 14 such that the plurality of arched members 14 is evenly spaced apart from each outer. The plurality of horizontal members 34 includes a pair of outward members 36 and a central member 38. Each of the pair of outward members 36 is recessed into a respective one of the outward portions 32 of each of the plurality of arched members 14. Additionally, the arched members 14 are evenly distributed along a full length of the pair of outward members 36. The central member 38 is recessed into the central portion 30 of each of the plurality of arched members 14 having each of the plurality of arched members 14 is evenly distributed along a full length of the central member 38.

A blanket 40 is positionable over the frame 12 such that the blanket 40 covers the user's legs 20. The blanket 40 is supported by the frame 12 to inhibit the user 22 from feeling the weight of the blanket 40 while still facilitating the user 22 to be warmed by the blanket 40. The blanket 40 is draped over the central portion 30 of each of the plurality of arched members 14 having the blanket 40 extending downwardly along each of the outward portions 32 of each of the plurality of arched members 14. In this way the blanket 40 extends beyond each end of the tunnel 16 defined by the frame 12. The blanket 40 may be a comforter, a knitted blanket or any type of blanket that the user 22 might wish to employ to keep warm. Furthermore, the user 22 may be a person that is recovering from knee surgery, for example, or other person that needs to protect their legs 20 from pressure or impact.

In use, the user 22 places the frame 12 over their legs 20 when the user 22 is either sitting down or lying down and the user 22 positions the blanket 40 over the frame 12. In this way the frame 12 supports the blanket 40 above the user's legs 20 to inhibit the user's legs 20 from being exposed to the weight of the blanket 40. Furthermore, the frame 12 protects the user's legs 20 from a pet, such as a dog for example, that might be inclined to walk across the user's legs 20 while the user 22 is seated or lying down. In this way the user 22 can recover from leg surgery, for example, without the fear of being injured by the blanket 40 or pets.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A blanket tunnel assembly for supporting a blanket above a user's legs when the user is either seated or lying down, said assembly comprising:

a frame having a plurality of arched members being strategically arranged such that said frame defines a tunnel wherein said frame is configured to be positioned on a support surface having said frame extending over a user's legs when the user is either lying on the support surface or sitting on the support surface, said frame being elongated wherein said frame is configured to extend over a full length of the user's legs when said frame is positioned over the user's legs; and a blanket being positionable over said frame wherein said blanket is configured to cover the user's legs, said blanket being supported by said frame wherein said frame is configured to inhibit the user from feeling the weight of said blanket while still facilitating the user to be warmed by said blanket;

wherein each of said arched members has a first end and a second end;

wherein each of said arched members has a pair of bends being equally spaced from a respective one of said first end and said second end to define a central portion extending between a pair of outward portions of said arched members;

wherein each of said outward portions of a respective arched member angles away from each other;

wherein said central portion of said respective arched member curves upwardly between said pair of outward members of said respective arched member;

wherein said frame includes a plurality of horizontal members, each of said horizontal members being attached between said plurality of arched members such that said plurality of arched members is evenly spaced apart from each outer;

wherein said plurality of horizonal members includes a pair of outward members and a central member;

wherein each of said pair of outward members is recessed into a respective one of said outward portions of each of said plurality of arched members;

wherein said plurality of arched members is evenly distributed along a full length of said pair of outward members; and wherein said central member is recessed into said central portion of each of said plurality of arched members having each of said plurality of arched members being evenly distributed along a full length of said central member.

2. The assembly according to claim 1, wherein said blanket is draped over said central portion of each of said plurality of arched members having said blanket extending downwardly along each of said outward portions of each of said plurality of arched members.

3. A blanket tunnel assembly for supporting a blanket above a user's legs when the user is either seated or lying down, said assembly comprising:

a frame having a plurality of arched members being strategically arranged such that said frame defines a tunnel wherein said frame is configured to be positioned on a support surface having said frame extending over a user's legs when the user is either lying on the support surface or sitting on the support surface, said frame being elongated wherein said frame is configured to extend over a full length of the user's legs when said frame is positioned over the user's legs, each of said arched members having a first end and a second end, each of said arched members having a pair of bends being equally spaced from a respective one of said first end and said second end to define a central portion extending between a pair of outward portions of said arched members, each of said outward portions of a respective arched member angling away from each other, said central portion of said respective arched member curving upwardly between said pair of outward members of said respective arched member, said frame including a plurality of horizontal members, each of said horizontal members being attached between said plurality of arched members such that said plurality of arched members is evenly spaced apart from each outer, said plurality of horizonal members including a pair of outward members and a central member, each of said pair of outward members being recessed into a respective one of said outward portions of each of said plurality of arched members, said plurality of arched members being evenly distributed along a full length of said pair of outward members, said central member being recessed into said central portion of each of said plurality of arched members having each of said plurality of arched members being evenly distributed along a full length of said central member; and a blanket being positionable over said frame wherein said blanket is configured to cover the user's legs, said blanket being supported by said frame wherein said frame is configured to inhibit the user from feeling the weight of said blanket while still facilitating the user to be warmed by said blanket, said blanket being draped over said central portion of each of said plurality of arched members having said blanket extending downwardly along each of said outward portions of each of said plurality of arched members such that said blanket extends beyond each end of said tunnel defined by said frame.

* * * * *